US007849656B2

(12) United States Patent
Mugge et al.

(10) Patent No.: US 7,849,656 B2
(45) Date of Patent: Dec. 14, 2010

(54) DRY CAST BLOCK ARRANGEMENT AND METHODS

(75) Inventors: Jimmie L. Mugge, Inver Grove Heights, MN (US); Jay J. Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 12/105,902

(22) Filed: Apr. 18, 2008

(65) Prior Publication Data

US 2009/0260314 A1 Oct. 22, 2009

(51) Int. Cl.
*E04C 3/30* (2006.01)

(52) U.S. Cl. ..... 52/604; 52/609; 52/596; 405/284; D25/113

(58) Field of Classification Search ..... 52/596, 52/601, 608, 609, 604; 405/285, 286, 284, 405/262; D25/113, 114, 115, 116, 117, 118; D21/484
See application file for complete search history.

(56) References Cited

U.S. PATENT DOCUMENTS

| | | | | |
|---|---|---|---|---|
| 415,773 | A | 11/1889 | Fiske | |
| 433,219 | A * | 7/1890 | Schwartz | 52/102 |
| 799,754 | A | 9/1905 | Petrie | |
| 803,104 | A | 10/1905 | MeIlravy | |
| 813,901 | A | 2/1906 | Leming | |
| 819,055 | A | 5/1906 | Fisher | |
| 824,235 | A | 6/1906 | Damon | |
| 838,278 | A | 12/1906 | Schwartz | |
| 888,530 | A * | 5/1908 | Pugh | 52/311.2 |
| 1,086,975 | A | 2/1914 | Aaronson | |
| 1,166,312 | A | 12/1915 | Barten | |
| 1,534,353 | A * | 4/1925 | Besser | 52/315 |

(Continued)

FOREIGN PATENT DOCUMENTS

DE 196 34 499 A1 5/1998

(Continued)

OTHER PUBLICATIONS

"Slab Molds, Dream Molds," KOBRA Formen GmbH, 2 pages (Date unknown).

(Continued)

*Primary Examiner*—Robert J Canfield
*Assistant Examiner*—Babajide Demuren
(74) *Attorney, Agent, or Firm*—Merchant & Gould P.C.

(57) ABSTRACT

A first concrete block has an exposure face with a non-planar first topographical definition and a first edge along the side face and a second edge along the second side face. The first edge has a first irregular profile. A second concrete block has an exposure face with a non-planar second topographical definition and a first edge and a second edge. The second topographical definition is different from the first topographical definition. The second edge of the second block has an irregular profile that is the mirror image of the first irregular profile. The blocks can be oriented adjacent and against each other for a seamless appearance. Assembling methods include orienting the first side of the first block against the second side of the second block and aligning the first irregular profile of the first block with the first irregular profile of the second block for a seamless appearance.

27 Claims, 7 Drawing Sheets

U.S. PATENT DOCUMENTS 1,564,490 A 12/1925 Parkhurst
1,574,123 A 2/1926 Sharpe
1,596,165 A 8/1926 Evans
1,693,852 A 12/1928 McQuain
1,776,999 A 9/1930 Jensen
1,795,451 A 3/1931 Sharpe
1,982,730 A 12/1934 Erkman
2,038,205 A 4/1936 Case
2,313,363 A 3/1943 Schmitt
2,457,368 A 12/1948 Hanson
2,517,432 A 8/1950 Hornberger
2,682,093 A 6/1954 Clanton
2,819,495 A 1/1958 Krausz
2,882,689 A * 4/1959 Huch et al. ..... 405/284
3,013,321 A 12/1961 McElroy
3,204,316 A 9/1965 Jackson
3,229,439 A * 1/1966 Strobel ..... 52/591.2
3,271,787 A * 9/1966 Clary ..... 52/716.2
3,277,551 A 10/1966 Sekiguchi
3,425,105 A 2/1969 Gulde
3,435,576 A * 4/1969 Giannelia ..... 52/300
3,508,367 A * 4/1970 Niebylski ..... 52/316
3,530,553 A 9/1970 Engle et al.
3,555,757 A 1/1971 Volent
3,635,459 A * 1/1972 Mare ..... 266/283
3,669,402 A 6/1972 Paulson
3,694,128 A 9/1972 Foxen
3,731,899 A 5/1973 Nuzzo
3,809,049 A 5/1974 Fletcher et al.
3,918,877 A 11/1975 Pickett
3,940,229 A 2/1976 Hutton
3,981,953 A 9/1976 Haines
4,050,864 A 9/1977 Komaki
4,063,866 A 12/1977 Lurbiecki
4,178,340 A 12/1979 Hyytinen
4,272,230 A 6/1981 Abate
4,290,712 A 9/1981 Hayes
4,310,994 A * 1/1982 Gephardt ..... 52/608
4,335,549 A * 6/1982 Dean, Jr. ..... 52/98
4,681,481 A * 7/1987 Kapusta ..... 404/34
4,711,606 A * 12/1987 Leling et al. ..... 405/286
4,738,059 A * 4/1988 Dean, Jr. ..... 52/98
D298,463 S 11/1988 Forsberg
4,784,821 A 11/1988 Léopold
4,802,836 A 2/1989 Whissell
4,860,505 A * 8/1989 Bender ..... 405/286
4,869,660 A 9/1989 Ruckstuhl
4,884,378 A * 12/1989 Scheiwiller ..... 52/169.4
4,902,211 A 2/1990 Svanholm
4,909,717 A 3/1990 Pardo
4,920,712 A 5/1990 Dean, Jr.
4,922,678 A * 5/1990 Scheiwiller ..... 52/570
4,986,042 A * 1/1991 Richardt ..... 52/102
4,993,206 A * 2/1991 Pardo ..... 405/286
D317,048 S 5/1991 Forsberg
D317,209 S 5/1991 Forsberg
5,017,049 A * 5/1991 Sievert ..... 405/284
5,028,167 A * 7/1991 Scheiwiller ..... 404/41
5,031,376 A * 7/1991 Bender et al. ..... 52/609
5,035,098 A * 7/1991 Newsom ..... 52/591.2
D319,885 S 9/1991 Blomquist et al.
D321,060 S 10/1991 Blomquist et al.
5,056,998 A 10/1991 Goossens
5,078,940 A 1/1992 Sayles
5,131,202 A * 7/1992 Ball ..... 52/596
5,183,616 A 2/1993 Hedrick
5,254,058 A * 10/1993 Savigny ..... 482/37
D341,215 S 11/1993 Blomquist et al.
5,294,216 A * 3/1994 Sievert ..... 405/286
D350,611 S 9/1994 Scales
D352,789 S 11/1994 Adam
5,366,676 A 11/1994 Kobayashi
5,435,949 A 7/1995 Hwang
D363,787 S 10/1995 Powell
5,484,236 A 1/1996 Gravier
5,534,214 A 7/1996 Sakamoto et al.
5,598,679 A 2/1997 Orton et al.
5,622,456 A * 4/1997 Risi et al. ..... 405/284
5,651,912 A 7/1997 Mitsumoto et al.
5,688,079 A * 11/1997 Bolduc et al. ..... 405/286
5,711,130 A * 1/1998 Shatley ..... 52/604
D391,376 S 2/1998 Strand et al.
5,735,643 A 4/1998 Castonguay et al.
5,744,081 A 4/1998 Tanigawa et al.
5,756,131 A 5/1998 Suh
5,816,749 A 10/1998 Bailey, II
5,827,015 A 10/1998 Woolford et al.
6,082,074 A * 7/2000 Shaw et al. ..... 52/742.14
D438,640 S 3/2001 Bolles et al.
6,205,728 B1 3/2001 Sutelan
6,233,897 B1 * 5/2001 Jurik ..... 52/604
6,321,740 B1 11/2001 Scherer et al.
6,390,952 B1 * 5/2002 Wilson ..... 482/37
6,455,113 B1 * 9/2002 Bilodeau ..... 428/15
6,490,837 B1 * 12/2002 Dueck et al. ..... 52/592.6
D482,133 S 11/2003 Scherer et al.
D486,246 S * 2/2004 Manthei ..... D25/113
D494,686 S * 8/2004 Mignone ..... D25/113
D511,578 S 11/2005 Mugge et al.
D513,805 S * 1/2006 Scherer et al. ..... D25/113
6,988,847 B2 * 1/2006 Lazar ..... 404/39
D518,578 S 4/2006 Mugge et al.
D529,195 S * 9/2006 Mugge ..... D25/113
D529,628 S 10/2006 Mugge et al.
D532,910 S 11/2006 Mugge et al.
7,140,867 B2 11/2006 Scherer et al.
D538,946 S 3/2007 Mugge et al.
7,207,146 B1 * 4/2007 Morrell ..... 52/561
7,208,112 B2 4/2007 Scherer
D541,950 S 5/2007 Mugge et al.
7,267,321 B1 * 9/2007 Morrell ..... 249/102
D586,478 S * 2/2009 Price et al. ..... D25/113
D588,714 S * 3/2009 Mugge et al. ..... D25/113
7,503,723 B2 * 3/2009 Nunn ..... 404/32
2003/0182011 A1 9/2003 Scherer
2003/0197310 A1 * 10/2003 Bailey et al. ..... 264/333
2004/0218985 A1 11/2004 Klettenberg et al.
2005/0099882 A1 * 5/2005 Johnson ..... 366/16
2005/0144883 A1 * 7/2005 Hopson et al. ..... 52/596
2006/0153647 A1 * 7/2006 Woolford et al. ..... 405/286
2006/0179777 A1 * 8/2006 Tufts et al. ..... 52/596
2006/0182923 A1 * 8/2006 Riccobene ..... 428/44

FOREIGN PATENT DOCUMENTS

DE 100 02 390 A1 7/2001
GB 944066 12/1963
GB 2 232 114 A 12/1990
WO WO 03/060251 A1 12/2002

OTHER PUBLICATIONS

"Kobra Slab Molds: Optimum Slab Production on Big Board Machines, Design and Benefits," KOBRA, 2 pages (Date unknown).

* cited by examiner

DRY CAST BLOCK ARRANGEMENT AND METHODS

TECHNICAL FIELD

This disclosure concerns concrete blocks and methods of making and using such blocks. Specifically, this disclosure pertains to a set of dry cast blocks that, when assembled together, give a seamless appearance.

BACKGROUND

Soil retention, protection of natural and artificial structures and increased land use are only a few reasons that motivate the use of landscape structures. For example, soil is often preserved on a hillside by maintaining the foliage across that plane. Root systems from trees, shrubs, grass and other naturally occurring plant life work to hold the soil in place against the forces of wind and water. When reliance on natural mechanisms is not possible or practical, an artificial mechanism such as a retaining wall can be utilized. Retaining walls can be made from individual blocks and constructed in courses. Examples of blocks and walls constructed using these blocks can be found in U.S. Pat. No. 7,048,472; U.S. Pat. No. 6,612,784; and U.S. Pat. No. 6,113,318, each of these patents being incorporated herein by reference. Blocks can be arranged into walls and be finished with cap blocks along the top edge of the wall. The cap blocks give a finished appearance to the wall.

Such blocks can also be used in a variety of landscaping applications. These landscaping types of applications utilize blocks in a variety of ways to enhance the appearance of the landscape.

When arranging blocks, including cap blocks, adjacent to each other, it is often desirable to simulate the appearance of natural rock or stone or other attractive appearances. One problem with simulating such appearances is the joint between two adjacent blocks. If the observer's eye is drawn to the joint, the wall can have an appearance of several blocks arranged next to each other, rather than the appearance of one continuous wall. Therefore, there is a need for blocks, such as retaining wall blocks and cap blocks, which have a structure that allow for a seamless appearance when arranged next to each other.

SUMMARY

In one aspect, a set of dry cast blocks is provided including a first dry cast block and a second dry cast block. The first dry cast block has at least six sides including a first exposure face, an opposite second face, opposite top and bottom faces extending between the first exposure face and second face, and opposite first and second side faces extending between the first exposure face and the second face and the top and bottom faces. The first exposure face has a non-planar first topographical definition, a first edge along the first side face, and a second edge along the second side face. The first edge has a first irregular profile shape extending in dimension from a straight line. The second dry cast block includes at least six sides including a first exposure face, an opposite second face, opposite top and bottom faces extending between the first exposure face and second face, and opposite first and second side faces extending between the first exposure face and second face and the top and bottom faces. The first exposure face of the second dry cast block has a non-planar second topographical definition, a first edge along the first side face, and a second edge along the second side face. The second topographical definition is different from the first topographical definition. The second edge of the second dry cast block has the first irregular profile shape extending in dimension from a straight line.

In another aspect, a dry cast block arrangement is provided. The dry cast block arrangement includes a first dry cast block and the second dry cast block as characterized above. The first dry cast block first side face is against the second dry cast block second side face. The first dry cast block first exposure face and the second dry cast block first exposure face are adjacent to each other. The first edge of the first exposure face of the first dry cast block is aligned with the second edge of the first exposure face of the second dry cast block to create a seamless appearance along the first exposure faces.

In another aspect, a set of dry cast blocks is provided including at least a first dry cast block and a second dry cast block. The first dry cast block includes at least 6 sides including a first exposure face, an opposite second face, opposite top and bottom faces extending between the first exposure face and second face, and opposite first and second side faces extending between the first exposure face and second face and the top and bottom faces; the first exposure face having a first 3-dimensional pattern and a first generally vertical edge along the first side face and a second generally vertical edge along the second side face; the first side face at first edge having a first irregular profile shape; and the second side face at the second edge having a profile shape that is the mirror image of the first side face at the first edge. The second dry cast block includes at least 6 sides including a first exposure face, an opposite second face, opposite top and bottom faces extending between the first exposure face and second face, and opposite first and second side faces extending between the first exposure face and second face and the top and bottom faces; the first exposure face of the second dry cast block having a second 3-dimensional pattern and a first generally vertical edge along the first side face and a second generally vertical edge along the second side face; the second 3-dimensional pattern being different from the first 3-dimensional pattern; the first side face at the first edge of the second dry cast concrete block having the same profile shape as that of the first side face at the first edge of the first dry cast concrete block; and the second side face at the second edge of the second dry cast block having the same profile shape as that of the side face at the second edge of the first dry cast concrete block.

In another aspect, a method of assembling a dry cast block arrangement includes providing a first dry cast block and a second dry cast block, as characterized above. Next, the first side face of the first dry cast block is oriented against the second side face of the second dry cast block. The method further includes aligning the first irregular profile shape of the second dry cast block to create a seamless appearance.

DETAILED DESCRIPTION

Figure 1:
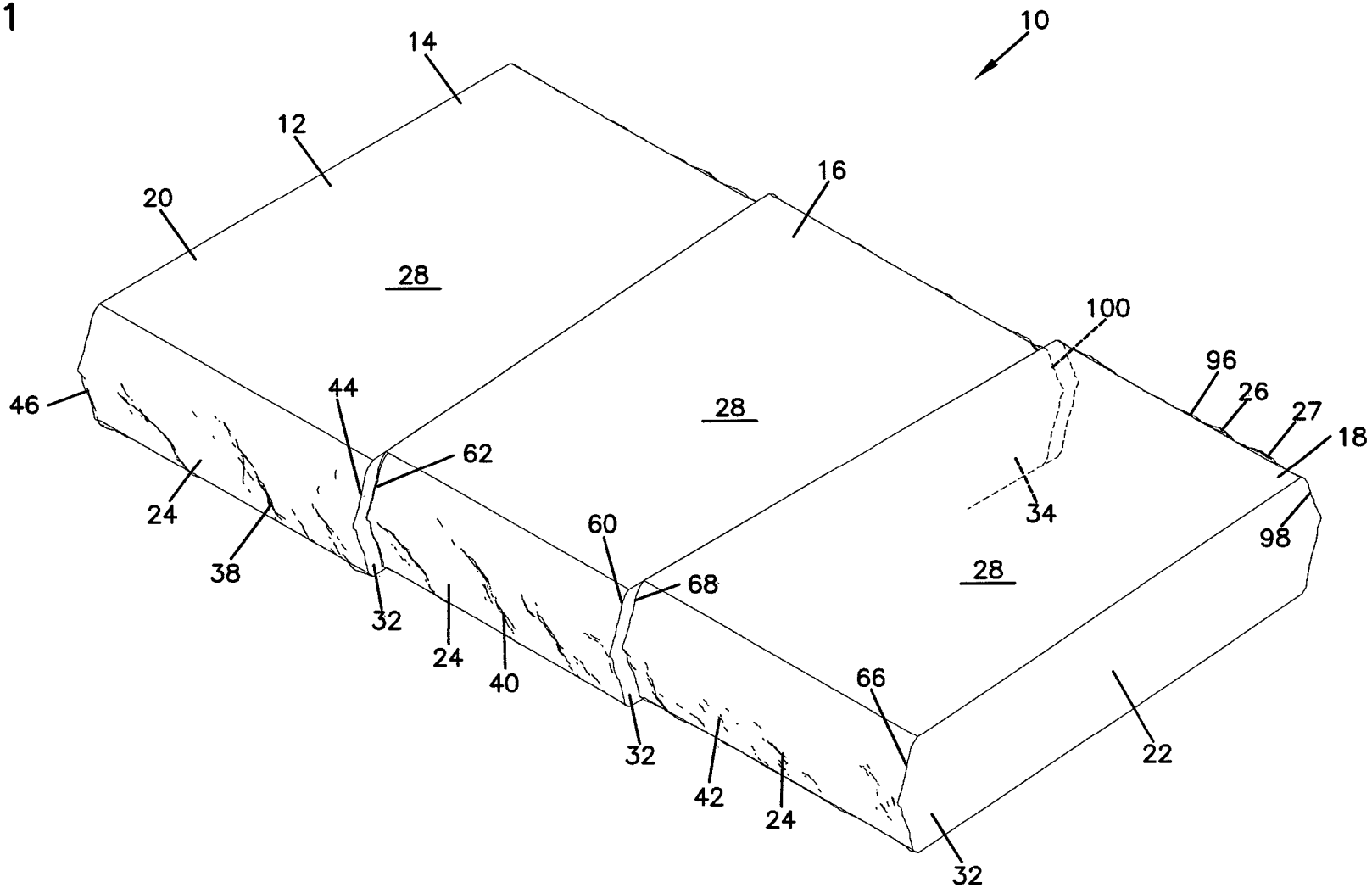
FIG. 1 is a perspective view of a dry cast block arrangement, just prior to aligning in a final form, constructed according to principles of this disclosure.

In FIG. 1, a dry cast block arrangement is illustrated in perspective view at reference numeral 10. The dry cast block arrangement 10, in the embodiment shown, shows a plurality of dry cast blocks arranged side-by-side, in a manner just prior to a final alignment. In this embodiment, there are three dry cast blocks 12, shown as first block 14, second block 16, and third block 18. FIG. 1 shows the blocks each slightly recessed from the adjacent block in order to illustrate certain preferred features at the interface at the blocks. When assembled for a wall or landscaping purposes, the blocks 12 will preferably not be recessed and, instead, will be even with each other to have a seamless appearance.

The blocks 12 are referred to as "dry cast" blocks because they are made from a dry cast process, as opposed to a wet cast process. A dry cast process utilizes dry cast, no slump concrete. The block is formed by using dry cast, no slump concrete in a mold and then cured. Dry cast no-slump concrete and processes for molding blocks utilizing such concrete are well-known in this art.

Figure 8:
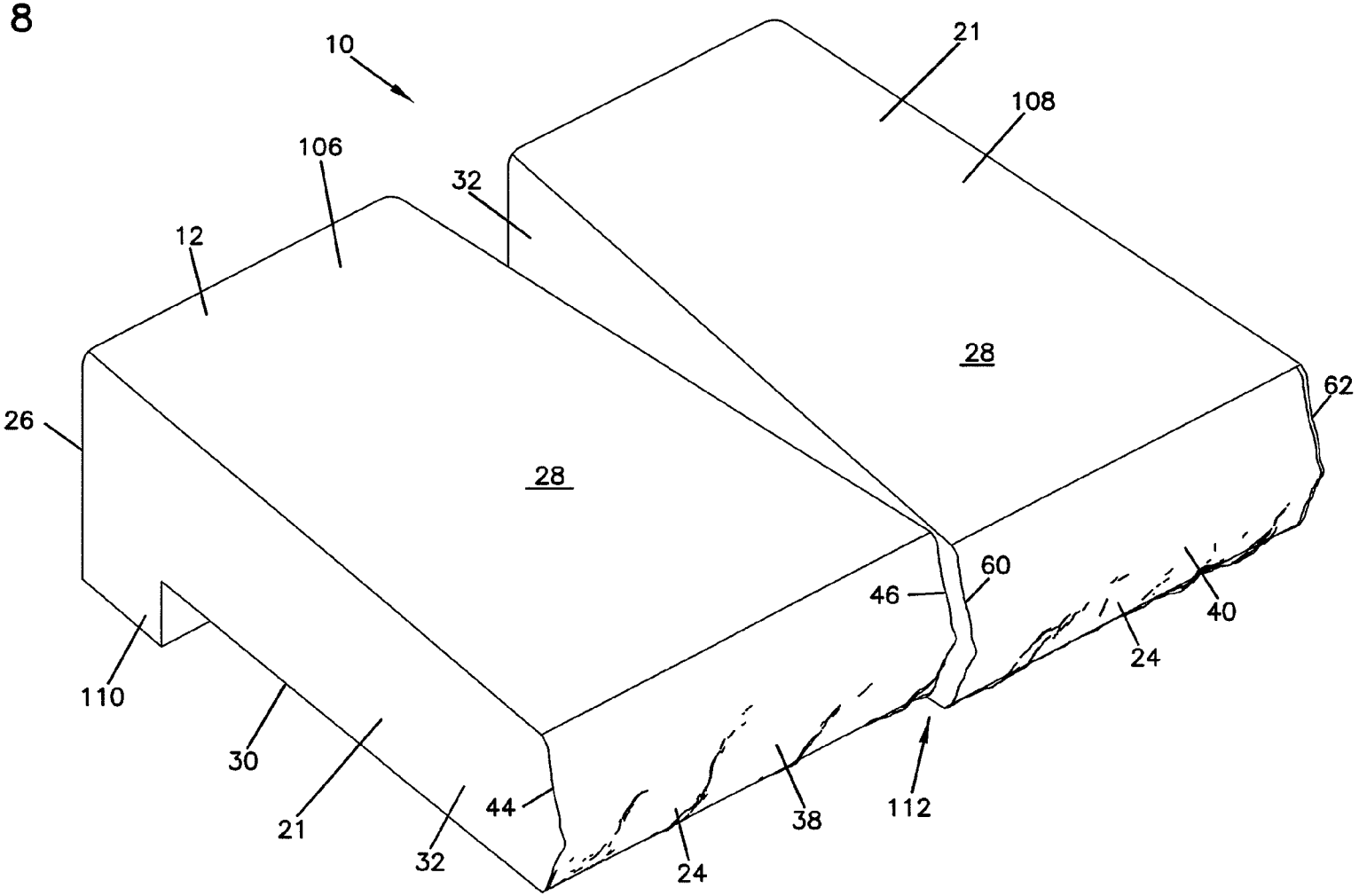
FIG. 8 is a schematic perspective view of a dry cast block arrangement, just prior to aligning in a final form, and depicting retaining wall blocks used in the arrangement, the retaining wall blocks being constructed according to principles of this disclosure.

In the embodiment depicted, the blocks 12 are cap blocks 20. That is, in the use depicted in FIGS. 1-5, the blocks 12 are used as cap blocks 20 to line the top end of a retaining wall or landscape structures. Although cap blocks 20 are depicted, principles described herein can be utilized for retaining wall blocks and other types of structures. In FIG. 8, for example, the block arrangement 10 depicted shows two blocks 12, and in this depicted embodiment, the blocks 12 are dry cast retaining wall blocks 21, shown as a first retaining wall block 106, and a second retaining wall block 108. The particular retaining wall blocks 21 depicted in FIG. 8 have a rear lip 110 to help in constructing a retaining wall. Other than certain features related to the interface 112 (described below) between adjacent retaining wall blocks 21, the retaining wall blocks 21 can be constructed and made in accordance with, for example, U.S. Pat. Nos. 7,048,472 and 7,208,112, each incorporated herein by reference. In addition, retaining wall blocks other than the rear lip style depicted in FIG. 8 can incorporate the principles of this disclosure, including blocks shown in, for example, U.S. Pat. Nos. 6,612,784 and 6,113,318, each incorporated herein by reference. The principles described herein are likewise applicable to a variety of dry cast free-standing blocks.

Figure 3:
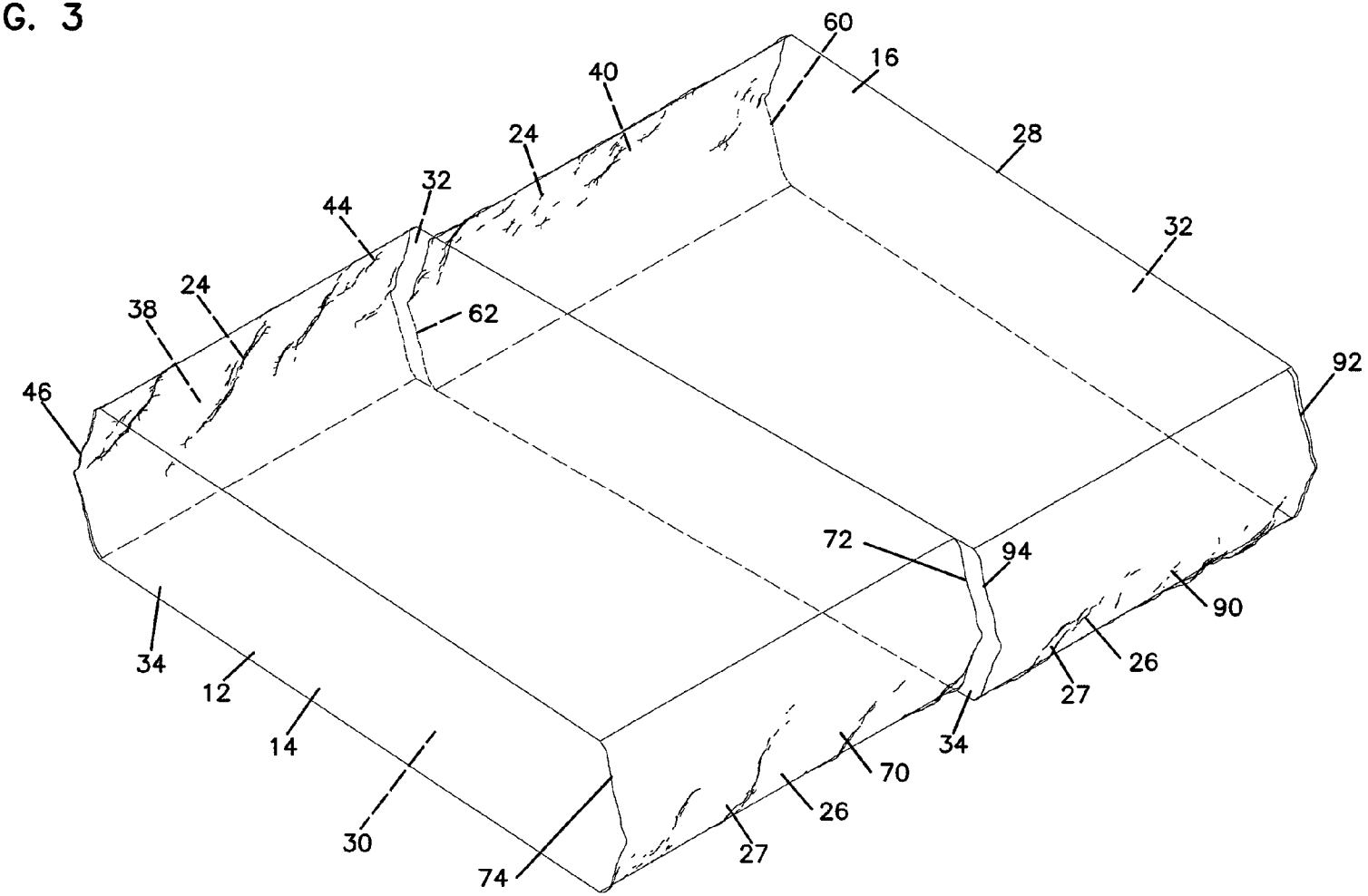
FIG. 3 is a rear perspective view of two of the blocks of the block arrangement of FIG. 1 just prior to aligning in a final form and depicting hidden lines to show the interface between the two blocks.

In the embodiments shown, each block 12 has at least six sides 22. The at least six sides 22 include at least a first exposure face 24. By the term "exposure face" it is meant the face of the block 12 that will have an appearance that is exposed for visibility and is not oriented directly against another block side 22. In preferred embodiments, each block 12 will include an opposite second face 26, which sometimes will be also a second exposure face 27 (FIG. 3), as in the illustrated embodiment. In FIG. 3, the first block 14 and the second block 16 are illustrated in perspective view and from an opposite perspective as FIG. 1. Further, in FIG. 3, certain hidden lines are shown, including the first exposure face 24 of the first and second blocks 14, 16.

Still in reference to FIGS. 1 and 3, each of the blocks 12 preferably includes a top face 28 extending between the first exposure face 24 and the second face 26. The top face 28 is indicated as a "top" face, because in the particular embodiment depicted in FIG. 1, it is facing upwardly and away from a mounting surface. It should be understood that blocks 12 of FIGS. 1-5 can be utilized with the top face 28 facing downwardly and against the mounting surface. In this instance, the term "top" is only a relative term, with respect to the other sides 22 of the block 12.

In the embodiment shown, there is also an opposite bottom face 30 (FIG. 3), shown in phantom lines in FIG. 3. The term "bottom" is a relative term, since in the embodiment of FIGS. 1-5, it is illustrated to be oriented at the bottom and against the mounting surface. In other uses, the bottom face 30 can be oriented upwardly and away from the mounting surface. The bottom face 30 extends between the first exposure face 24 and second face 26. In preferred embodiments, both the top face 28 and the bottom face 30 are planar and flat.

Still in reference to FIGS. 1 and 3, in the embodiment depicted, each of the blocks 12 also includes opposite first and second side faces 32, 34 extending between the first exposure face 24 and second face 26 and the top and bottom faces 28, 30. In the embodiment shown, the first and second side faces 32, 34 are flat and planar.

Figure 5:
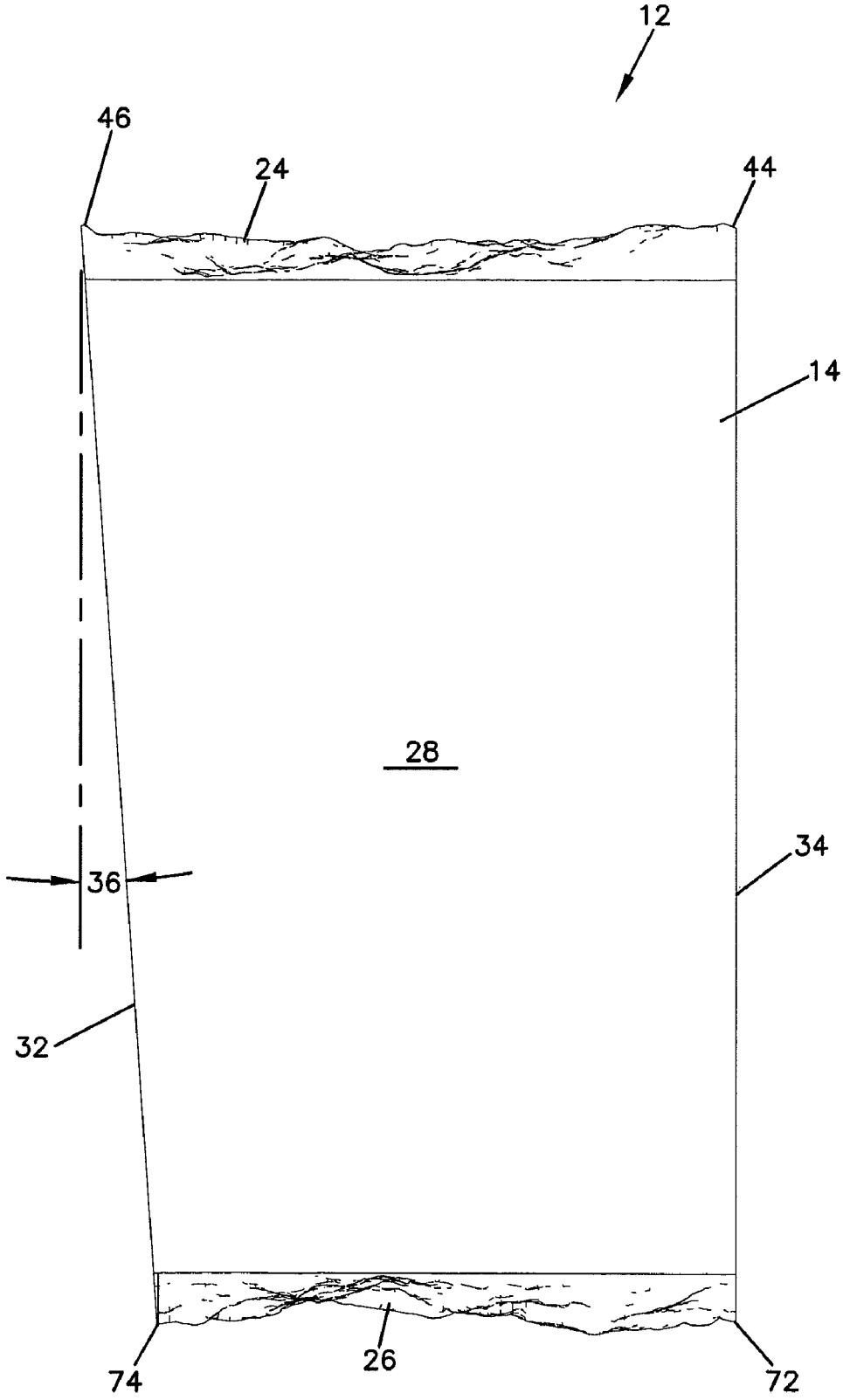
FIG. 5 is a top plan view of one of the blocks of the block arrangement of FIGS. 1-4.

In preferred embodiments, each block 12 will have a shape that allows the blocks 12 to be placed adjacent to each other and also allow the blocks to be adjacent to each other to form a curved wall without exposing gaps between adjacent blocks. One way this is accomplished is by tapering at least one of the first and second side faces 32, 34. One example is shown in the embodiment of FIG. 5. In FIG. 5, the first side face 32 is tapered at an angle 36 relative to a vertical axis. In the embodiment shown, the second side face 34 is straight and non-tapered. In other implementations, both the first side face 32 and second side face 34 can be tapered. For example, in the embodiment of FIG. 8, the first side face 32 and second side face are both tapered from the first exposure face 24 inwardly toward the second face 26. Referring again to FIG. 5, the angle 36 can vary depending upon how much curvature will be desired in the final wall that is constructed. The embodiment shown in FIG. 5 has an angle 36 of less than 10 degrees, for example, 1-5 degrees. As a result of this taper, one of the faces 24, 26 has a width that is greater than the opposite face 26, 24. In the embodiment shown in FIG. 5, the first exposure face 24 has a width that is greater than the second face 26. Example embodiments include the first exposure face 24 as having a width that is no greater than 25% of the second face 26, for example, a width that is 10-20% greater than the width of the second face 26. In the embodiment shown, each of the blocks 14, 16, 18 is generally identical in shape, size, and weight.

In accordance with principles of this disclosure, the first exposure face 24 of the first block 14, 106 has a non-planar first topographical definition 38, also referred to herein as a first 3-dimensional pattern 38. The second block 16, 108 has a non-planar second topographical definition 40 (or second 3-dimensional pattern 40) at its first exposure face 24. Further, the third block 18 has a non-planar third topographical definition 32 (or third 3-dimensional pattern) at its first exposure face 24. The non-planar first topographical definition 38, the non-planar second topographical definition 40, and the non-planar third topographical definition 42 are different from each other. By the term "non-planar topographical definition," or the term "3-dimensional pattern", it is meant a three-dimensional arrangement of physical attributes not contained within a single plane, which can include at least one peak projecting from a vertical plane normal to the plane of the top and bottom faces 28, 30 of at least 0.5 inch, and may further include a plurality of peaks (projections) or smooth hills some of which may be uniform in height or vary between 0.1 inch and up to 2 inches (for example), one or a plurality of reliefs recessed from the peaks (projections) or hills, and a general non-planar contoured surface; such structure can include a craggy, irregular appearance, simulating a stone face, or for example, it can include a regular, patterned appearance. Each of the first topographical definition 32 (first 3-dimensional pattern 32), second topographical definition 40 (second 3-dimensional pattern 40), and third topographical definition 42 (third 3-dimensional pattern 42) are different in structure, and hence appearance, from each other. By "different," it is meant a structural difference that is appreciably noticeable (detectable) by a human eye, when viewing the exposure faces 24 side by side.

The first exposure face 24 of the first block 14, 106 has a first edge 44 along the first side face 32. That is, the first edge 44 is at the intersection of the first exposure face 24 and the first side face 32. Likewise, the first exposure face of the first block 14, 106 has a second edge 46 along the second side face 34 (FIG. 3). The first edge 44 has a first irregular profile shape 48 (FIG. 6) extending in dimension from a straight line, explained below. In preferred embodiments, the second edge 46 has an irregular profile shape that is the mirror image of the first irregular profile shape 44, when viewed in three dimensions. When viewed in two dimensions (as a line only, absent the rest of the block 12) the first and second edges 44, 46 are the same and also are a mirror image of each other.

Figure 6:
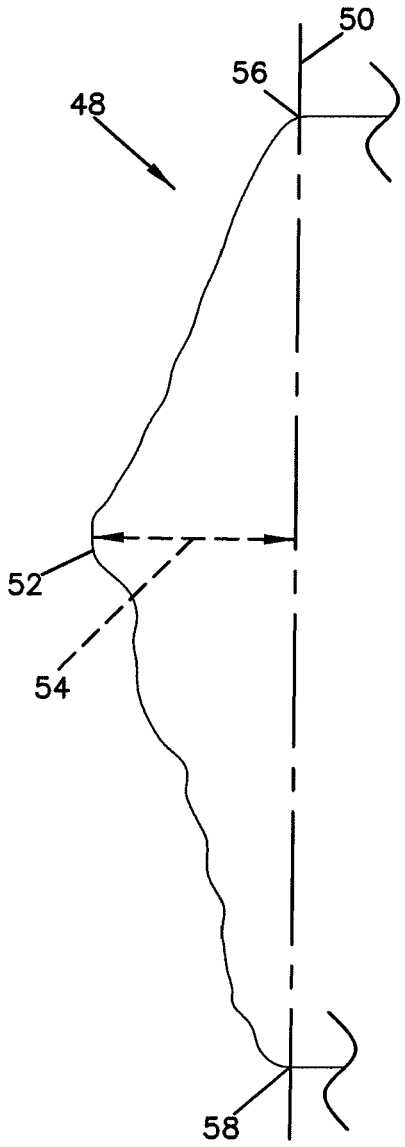
FIG. 6 is an enlarged, schematic view of a first profile shape of one of the exposure face's edge, constructed according to principles of this disclosure.

In FIG. 6, a straight line is shown at 50, and the profile shape 48 can be seen projecting or extending from straight line 50. Of course, a variety of profile shapes are usable, and in the specific embodiment illustrated in FIG. 6, the profile shape 48 extends to an outermost apex 52. The apex 52, in the embodiment shown, is located between 40-60% of a vertical distance between uppermost point 56 and lowermost point 58, along the profile shape 48. In this particular illustrated embodiment, the apex 52 projects a distance 54 from the straight line 50 of at least 15% of the overall length of the profile shape 48, when the length is measured along the straight line 50 from the uppermost point 56 to lowermost point 58. The distance 54 will typically be 20-40%, for example, about 22-28% of the overall straight-line length of the profile shape 48, and can include a distance of at least 0.05 inch, for example 0.1-1 inch, sometimes generally less than 2 inches. The profile shape 48 between the apex 52 and the uppermost point 56 can have a variety of shapes, including irregular, curved, or straight, for example, and in the embodiment shown, in roughly straight. Likewise, the profile shape between apex 52 and lowermost point 58 can also have a variety of shapes including irregular, curved, or straight, and in the embodiment shown is irregular including some curves, projections, reliefs, etc.

The second block 16, 108 has at its second topographical definition 40 a first edge 60 along the first side face 32 and a second edge 62 along the second side face 34 (FIG. 3). In preferred embodiments, the first edge 60 of the second block 16, 108 has the same profile shape 48 as that of the first edge 44 of the first block 14, 106; and in preferred embodiments, the second edge 62 of the second block 16, 108 has the same first profile shape 48 as the second edge 46 of the first block 14, 106. In preferred embodiments, the two dimensional line profile 48 of the second edge 62 of the second block 16, 108 is the same as the two dimensional line profile 48 of the first edge 44 of the first block 14, 106.

Figure 2:
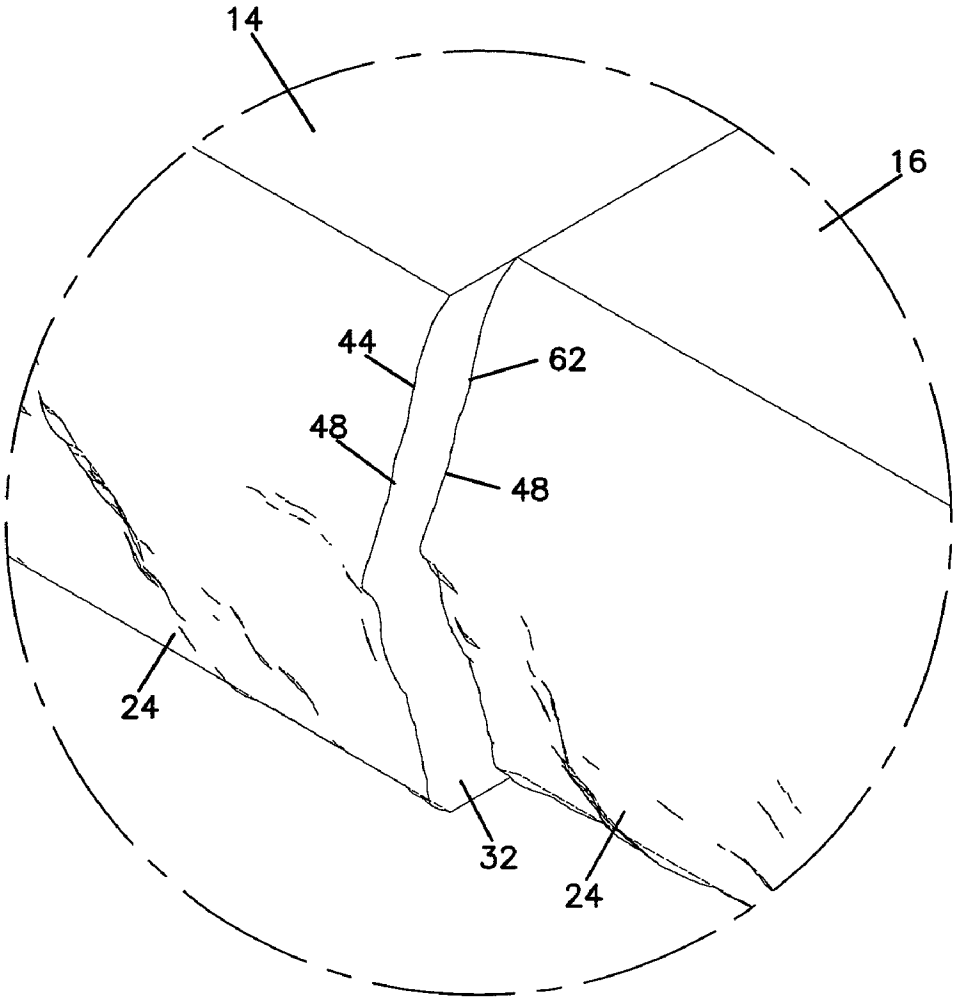
FIG. 2 is an enlarged perspective view of a portion of two of the blocks in the block arrangement of FIG. 1 at an interface therebetween.
Figure 4:
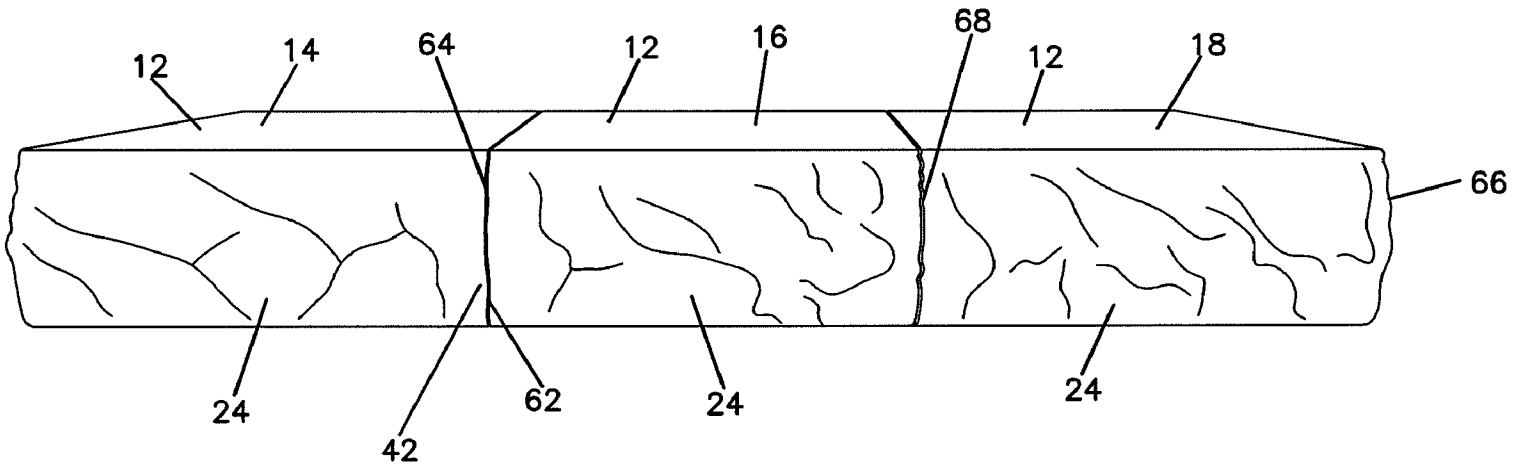
FIG. 4 is a front elevational view of the block arrangement of FIG. 1 after the blocks have been aligned together to result in a seamless front appearance.

One of the reasons for this type of preferred structure can be appreciated by viewing FIG. 2. FIG. 2 shows the first and second blocks 14, 16 with the first side face 32 of the first block 14 pressed against the second side face 34 (FIG. 3) of the second block 16, with the respective first exposure faces 24 adjacent to each other but before the blocks 14 and 16 are aligned to be even with each other. When the first exposure faces 24 of the blocks 14, 16 are put in alignment to be even with each other, the first edge 44 will match and align up with the second edge 62 of the second block 16. This is because the first edge 44 is a mirror-image of the second edge 62, and they have the same two dimensional first profile shape 48. When they are aligned in this manner, there is a smoother appearance along the respective first exposure faces 24, creating a seamless appearance, as can be seen in FIG. 4. By the term "seamless appearance," it is meant an appearance where, although there may be a vertical line that is viewable, such as line 64 in FIG. 4, there is otherwise a smooth contour along the respective first exposure faces 24 such that there are no abrupt changes at the interface between adjacent blocks 12. In FIG. 8, the second edge 46 of the first block 106 is shown just prior to alignment with the first edge 60 of the second block 108 at interface 112; again, in this view, the second edge 46 of the first block 106 is a mirror image of the first edge 60 of the second block 108, and they have the same two dimensional profile shape 48. When put into final alignment, although a vertical line may be visible at interface 112 between the adjacent blocks 106, 108, there will be an otherwise seamless appearance between the contours of the respective first exposure faces 24.

The third block 18 has third topographical definition 32 at its exposure face 24. It also includes a first edge 66 along the first side face 32 of the third block 18 and a second edge 68 along the second side face 34 of the third block 18. In the particular embodiment illustrated in FIGS. 1 and 4, the second edge 68 preferably has the first profile shape 48 such that it can be adjacent to the first edge 44 of the first block 14, or as in the embodiment shown, the first edge 60 of the second block 16. In preferred embodiments, the first edge 60 of the second block 16 has the same first profile shape 48. In preferred embodiments, each of the first and second edges 44, 46 (first block 14); 60, 62 (second block 16); and 66, 68 (third block 18) have the same two-dimensional first profile shape 48. It should be understood that although each of these blocks 14, 16, 18 have the same first profile shape 48 along their respective first and second edges, the first exposure face 24 of each of these blocks is different and has a different outward appearance.

As mentioned above, in some embodiments, the second face 26 is also a second exposure face 27. In the embodiments of FIGS. 1-4, the blocks 12 include the second face 26 as second exposure face 27. In the illustrated embodiments of FIGS. 1-4, the first dry cast block 14 has on its second exposure face 27 a second exposure face non-planar first topographical definition 70 (FIG. 3) (also referred to herein as a second exposure face first 3-dimensional pattern 70.)

The first topographical definition 70 (second exposure face first 3-dimensional pattern 70) of the second exposure face 27 of the first block 12 has a third edge 72 along the first side face 32 and a fourth edge 74 along the second side face 34 (FIG. 3). In preferred embodiments, the third edge 72 has a second irregular profile shape 78 depicted in FIG. 7. In the embodiment shown, the second irregular profile shape 78, as a two dimensional line, is a mirror-image of the first profile shape 48, as a two-dimensional line. As such, the second irregular profile shape 78 extends in dimension from straight line 80 and includes apex 82. It further has the same characterizations of distance 84 as distance 54, and the shape of the profile 78 between point 86 and apex 82 is the mirror-image of the shape of the profile 48 between point 56 and apex 52. Likewise, the shape of the profile 78 between point 88 and apex 82 is a mirror-image of the shape of the profile 48 between point 58 and apex 52. In preferred embodiments, the fourth edge 74 is a mirror image of the third edge 72, in 3-dimensions, and the two dimensional profile line of the fourth edge 74 is the same as the two dimensional profile line of the second profile 78.

The second block 16 has on its second exposure face 27 a second exposure face non-planar second topographical definition 90 (second exposure face second 3-dimensional pattern 90). It differs in structure and appearance from the second exposure face non-planar first topographical definition 70 (second exposure face first 3-dimensional pattern 70). The second exposure face non-planar second topographical definition 90 includes a third edge 92 along the first side face 32 (FIG. 1 and shown in phantom in FIG. 3) and extending between the top and bottom face 28, 30. It has a fourth edge 94 along the second side face 34 extending between the top face 28 and bottom face 30. In preferred embodiments, the third edge 92 and the fourth edge 94 of the second block 16 has the second irregular profile shape 78 extending in dimension from straight line 80 (FIG. 7), when viewed in two dimensions; preferably, the third and fourth edges 92, 94 are mirror images of each other. In preferred arrangements, the third edge 92 has the same second irregular profile shape 78 as the third edge 72; and preferably, the fourth edge 94 has the same irregular profile shape 78 as the fourth edge 74.

Figure 7:
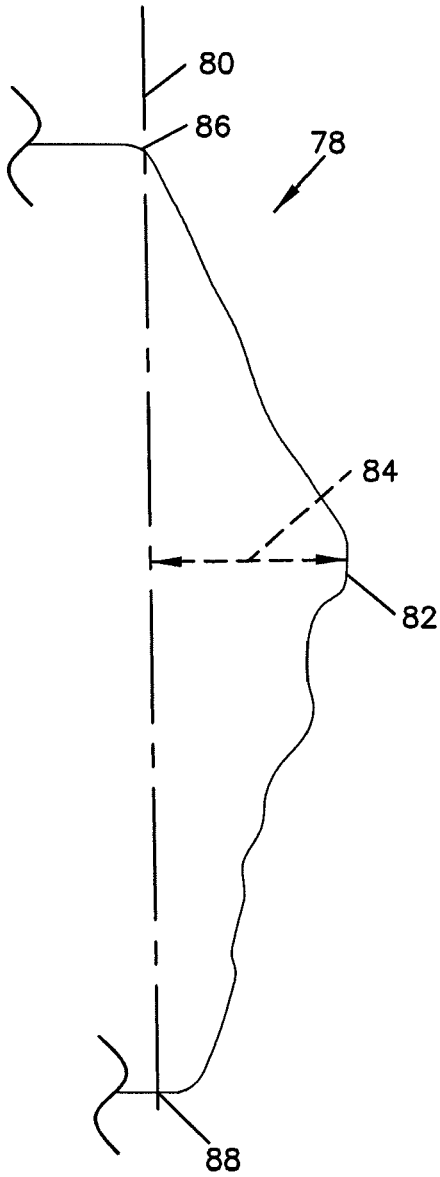
FIG. 7 is an enlarged, schematic view of a second profile shape of another edge of one of the exposure faces, which is the mirror-image of the profile shape of FIG. 6.

Preferably, the third block 18 has second exposure face 27 and which includes a second exposure face non-planar third topographical definition 96 (a second exposure face third 3-dimensional pattern 96) (FIG. 1). The second exposure face non-planar third topographical definition 96 includes a third edge 98 along the first side face 32 and a fourth edge 100 (shown in phantom in FIG. 1) along the second side face 34 (shown in phantom in FIG. 1) of the third block 18. In preferred embodiments, the third edge 98 and the fourth edge 100 of the third block 18 has the second irregular profile shape 78 extending from straight line 80 (FIG. 7). In preferred embodiments, the third edge 98 has the same profile 78 as the third edges 72, 92; and preferably, the fourth edge 100 has the same irregular profile shape 78 as the fourth edges 74, 94. Preferably, the third edge 98 and the fourth edge 100 are mirror-images.

As explained above, in the example embodiment illustrated, the second exposure face 26 of each of the blocks 14, 16, 18 has third edges 72, 92, 98 and fourth edges 74, 94, 100 as having the second irregular profile shape 78. This means that when the blocks 14, 16, 18 are aligned in a way that the side faces 32, 34 are against each other, then the second exposure faces 27 can be put adjacent to each other and in even alignment to result in a seamless appearance of blocks 14, 16, 18 along the contour of the respective second exposure faces 27. In FIG. 3, for example, it can be seen how the third edge 72 of the first block 12 can be moved in alignment with the fourth edge 94 of the second block 16. When this is done, although a vertical line may be viewable, the contour of the second exposure face non-planar first topographical definition 70 and the contour of the second exposure face non-planar second topographical definition 90 will be smooth and seamless in appearance. Likewise, the third block 16 can be arranged next to the first block 14 or the second block 16 in this fashion.

By reviewing FIG. 3, in can be appreciated that in the example embodiment illustrated, the first side face 32 of each of the blocks 14, 16, 18 will have the same perimeter outline: a straight edge at the top edge adjacent the top face 28, a straight edge at a bottom edge adjacent to the bottom face 30, first irregular profile shape 48 adjacent to the first exposure face 24 and extending between top face 28 and bottom face 30, and second irregular profile shape 78 adjacent to the second exposure face 26 and extending between top face 28 and bottom face 30. Likewise, in the example embodiment illustrated, the second side face 34 of each of the blocks 14, 16, 18 will have the same perimeter outline: a straight edge at the top edge adjacent the top face 28, a straight edge at a bottom edge adjacent to the bottom face 30, first irregular profile shape 48 adjacent to the first exposure face 24 and extending between top face 28 and bottom face 30, and second irregular profile shape 78 adjacent to the second exposure face 26 and extending between top face 28 and bottom face 30. In the example shown, the first side face 32 and second side face 34 of each of the blocks 14, 16, 18 will also have the same perimeter outline.

Of course, it should be realized a plurality of blocks 12 can be utilized in the block arrangement 10. The plurality can include only two blocks 12, or the plurality may include three, four, or more than four blocks 12. When a plurality of blocks 12 are used, for each block, each can have a unique non-planar topographical definition (3-dimensional pattern) that is different from the non-planar first topographical definition (first 3-dimensional pattern) and non-planar second topographical definition (second 3-dimensional pattern) and other blocks in the plurality. In such pluralities, each of the blocks 12 can have first and second edges at the intersection of the exposure face and respective side faces that are mirror images of each other with substantially identical profiles (generally irregular extending in dimension from a straight line). If the blocks also have a second exposure face, the second exposure faces can be unique from all others and can similarly have edges that are mirror images of each other with substantially identical profiles, extending in dimension from a straight line. Of course, in constructing walls or other structures using blocks, some of the blocks can have the same exposure face features as others, and some of the blocks can be plain, or flat, and/or unornamented.

Because of the symmetrical relationship between the first profile shape 48 and the second profile shape 78, the blocks 12 can also be arranged in a manner in which the first exposure face 24 of one block is adjacent to the second face 26 (which can be a second exposure face 27) of a second block, and the first profile 48 of the first block will align with the second profile shape 78 of the second block. This arrangement can be done as long as both blocks have their respective top faces 28 adjacent to each other and their respective bottom faces 30 adjacent to each other. In other words, unless the first and second profile shapes 48, 78 are also made to be symmetrical about a horizontal axis, then when aligning the blocks with the second face 26 (or exposure face 27) next to the first exposure face 24, all of the blocks need to have all of the top faces 28 extending upwardly or have all need to have the top faces 28 extending downwardly. If one of the blocks has the top face 28 extending up, while an adjacent block has the top face 28 extending down, then the profile shapes 48, 78 will not align with each other, in the embodiment shown.

It should be understood that the blocks 12 can be used in methods of assembling the dry cast block arrangement 10 by providing individual ones of the first block 14, 106 and second block 16, 108. Next, the first side face 32 of the first block 14, 106 is oriented against the second side face 34 of the second block 16, 108. Next, the first irregular profile shape 48 of the first block 14, 106 is aligned with the first irregular profile shape 48 of the second block 16, 108 to create a seamless appearance. The third block 18 can be added to the first and second blocks 14, 16, by again, aligning the first irregular profile shape 48 of the third block 18 with the first irregular profile shape 48 of one of the first and second blocks 14, 16, with the side faces adjacent and against each other and the first exposure faces 24 adjacent to each other.

In still other methods, the blocks 14, 16, 18 can be provided and the first exposure face 24 of the first block 14 can be aligned next to one of the side faces 32, 34 of another of the blocks 12. This method includes selecting the first exposure face 24 of the first block 14 to be adjacent to either the first exposure face 24 or the second exposure face 27 of the adjacent block. When arranging these blocks next to each other, the irregular profile shapes 48 or 78 will be aligned with each other to give a seamless appearance. In one such method, first selected ones of the blocks will have the first exposure face 24 facing the same direction, and other selected ones of the blocks will have the first exposure face 24 facing an opposite direction as the first selected ones of the blocks, as long as the top faces 28 for each of the blocks also face the same direction.

Blocks 12 can be made in a dry cast molding process by putting no slump dry cast concrete into a mold. The mold will have moveable side walls so that the first and second exposure faces 24, 26 can be created by the moveable side walls and then moved out of the way when de-molding. In such a process, the top face 28 and bottom face 30 will have flat sides, as will the first side face 32 and second side face 34. After de-molding, the blocks 12 are cured, using conventional techniques known in the art.

We claim:

1. A set of concrete blocks comprising:

(a) a first concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face having a non-planar first topographical definition that is irregular both along the length and across the height of the first exposure face and a first edge along the first side face and a second edge along the second side face;

(A) the first edge having a first irregular profile; and (b) a second concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face of the second concrete block having a non-planar second topographical definition that is irregular both along the length and across the height of the first exposure face and a first edge along the first side face and a second edge along the second side face;

(A) the second topographical definition being different from the first topographical definition;

(B) the second edge of the second concrete block having an irregular profile that is the mirror image of said first irregular profile so that when the second edge of the second concrete block is placed adjacent the first edge of the first concrete block and the edge profiles are aligned, there is a seamless appearance along the respective first exposure faces.

2. The set of concrete blocks of claim 1 wherein:

(a) the second edge of the first concrete block has a profile that is the mirror image of said first irregular profile; and (b) the first edge of the second concrete block has said first irregular profile.

3. The set of concrete blocks of claim 1 wherein the first concrete block top and bottom faces are flat; and the second concrete block top and bottom faces are flat.

4. The set of concrete blocks of claim 1 wherein the first concrete block first exposure face is wider than the first concrete block second face; and the second concrete block first exposure face is wider than the second concrete block second face.

5. The set of concrete blocks of claim 1 wherein the first concrete block and the second concrete block are substantially identical to each other in dimensional size and weight.

6. The set of concrete blocks of claim 1 wherein:

(a) the second face of the first concrete block is a second exposure face and has a second exposure face non-planar first topographical definition and a third edge along the first side face and a fourth edge along the second side face; the second exposure face non-planar first topographical definition is irregular both along the length and across the height of the second exposure face;

(i) the third edge having a second irregular profile that is the mirror image of the first irregular profile;

(ii) the fourth edge having an irregular profile that is the mirror image of said second irregular profile;

(b) the second face of the second concrete block is a second exposure face and has a second exposure face non-planar second topographical definition and a third edge along the first side face and a fourth edge along the second side face; the second exposure face non-planar second topographical definition is irregular both along the length and across the height of the second exposure face;

(i) the second exposure face non-planar first topographical definition being different from the second exposure face non-planar second topographical definition;

(ii) the third edge of the second concrete block having said second irregular profile; and (iii) the fourth edge of the second concrete block having an irregular profile that is the mirror image of said second irregular profile so that when the fourth edge of the second concrete block is placed adjacent the third edge of the first concrete block and the edge profiles are aligned, there is a seamless appearance along the respective second exposure faces.

7. The set of concrete blocks of claim 6 further comprising:

(a) a plurality of concrete blocks in addition to the first and second concrete blocks; each of the concrete blocks in the plurality having (i) at least 6 sides including opposite first and second exposure faces, opposite top and bottom faces extending between the first and second exposure faces, and opposite first and second side faces extending between the first and second exposure faces and the top and bottom faces;

(ii) the first exposure face of each of the concrete blocks in the plurality having a unique non-planar topographical definition, a first edge along the first side face, and a second edge along the second side face;

(A) each unique non-planar topographical definition being different from the non-planar first topographical definition and non-planar second topographical definition and other blocks in the plurality; and (B) each first edge having said first irregular profile and each second edge having an irregular profile that is the mirror image of the first irregular profile.

8. The set of concrete blocks of claim 7 wherein:

(a) the second exposure face of each of the concrete blocks in the plurality having a unique non-planar topographical definition, a third edge along the first side face and a fourth edge along the second side face;

(i) each unique non-planar topographical definition of the second exposure face of the concrete blocks in the plurality being different from the second exposure face non-planar first topographical definition and the second exposure face non-planar second topographical definition and other blocks in the plurality; and (ii) each third edge of the concrete blocks in the plurality having said second irregular profile and each fourth edge having an irregular profile that is the mirror image of the second irregular profile.

9. The set of concrete blocks of claim 1 further comprising:

(a) a plurality of concrete blocks in addition to the first and second concrete blocks; each of the concrete blocks in the plurality having (i) at least 6 sides including a first exposure face, an opposite second face, opposite top and bottom faces extending between the first exposure face and the second face, and opposite first and second side faces extending between the first exposure face and second face and the top and bottom faces;

(ii) the first exposure face of each of the concrete blocks in the plurality having a unique non-planar topographical definition, a first edge along the first side face, and a second edge along the second side face;

(A) each unique non-planar topographical definition being different from the non-planar first topographical definition and non-planar second topographical definition and other blocks in the plurality; and (B) each first edge having said first irregular profile and each second edge having an irregular profile that is the mirror image of the first irregular profile.

10. The set of concrete blocks of claim 1 wherein:

(a) the first concrete block is a cap block; and (b) the second concrete block is a cap block.

11. The set of concrete blocks of claim 1 wherein:

(a) the first concrete block is a retaining wall block;

(b) the second concrete block is a retaining wall block; and (c) the first and second concrete blocks are dry cast concrete blocks.

12. A set of concrete blocks according to claim 1 wherein:

(a) the first concrete block non-planar first topographical definition includes: (i) a plurality of projections projecting from the first generally vertical exposure face; and (ii) a plurality of reliefs recessed from the projections; and (b) the second concrete block non-planar second topographical definition includes: (i) a plurality of projections projecting from the first generally vertical exposure face; and (ii) a plurality of reliefs recessed from the projections.

13. A concrete block arrangement comprising:

(a) a first concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face having a non-planar first topographical definition that is irregular both along the length and across the height of the first exposure face and a first edge along the first side face and a second edge along the second side face;

(A) the first edge having a first irregular profile; and (b) a second concrete block adjacent to and against the first concrete block, the second concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face of the second concrete block having a non-planar second topographical definition that is irregular both along the length and across the height of the first exposure face and a first edge along the first side face and a second edge along the second side face;

(A) the second edge having an irregular profile that is the mirror image of said first irregular profile and being adjacent to the first edge of the first exposure face of the first concrete block;

(iii) wherein the first concrete block first side face is against the second concrete block second side face; the first concrete block first exposure face and the second concrete block first exposure face are adjacent to each other; and the first edge of the first exposure face of the first concrete block is aligned with the second edge of the first exposure face of the second concrete block to create a seamless appearance along the respective first exposure faces.

14. The concrete block arrangement of claim 13 wherein:

(a) the second face of the first concrete block is a second exposure face and has a second exposure face non-planar first topographical definition and a third edge along the first side face and a fourth edge along the second side face; the second exposure face non-planar first topographical definition is irregular both along the length and across the height of the second exposure face;

(i) the third edge having a second irregular profile that is the mirror image of the first irregular profile;

(b) the second face of the second concrete block is a second exposure face and has a second exposure face non-planar second topographical definition and a third edge along the first side face and a fourth edge along the second side face; the second exposure face non-planar second topographical definition is irregular both along the length and across the height of the second exposure face;

(i) the second exposure face non-planar second topographical definition being different from the second exposure face non-planar first topographical definition;

(ii) the fourth edge of the second concrete block having an irregular profile that is the mirror image of said second irregular profile;

(c) wherein the first concrete block second exposure face and the second concrete block second exposure face are adjacent to each other; and the third edge of the second exposure face of the first concrete block is aligned with the fourth edge of the second exposure face of the second concrete block to create a seamless appearance along the respective second exposure faces.

15. The concrete block arrangement of claim 14 further including:

(a) a plurality of concrete blocks in addition to the first and second concrete blocks; each of the concrete blocks in the plurality having (i) at least 6 sides including opposite first and second exposure faces, opposite top and bottom faces extending between the first and second exposure faces, and opposite first and second side faces extending between the first and second exposure faces and the top and bottom faces;

(ii) the first exposure face of each of the concrete blocks in the plurality having a unique non-planar topographical definition, a first edge along the first side face, and a second edge along the second side face;

(A) each unique non-planar topographical definition being different from the non-planar first topographical definition and non-planar second topographical definition and other blocks in the plurality; and (B) each first edge having said first irregular profile and each second edge having an irregular profile that is the mirror image of the first irregular profile;

(b) wherein each block of the plurality of concrete blocks is adjacent to and against another of the concrete blocks so that respective first exposure faces are adjacent and first edges are aligned with second edges to create a seamless appearance.

16. The concrete block arrangement of claim 15 wherein:

(a) the second exposure face of each of the concrete blocks in the plurality having a unique non-planar topographical definition, a third edge along the first side face and a fourth edge along the second side face;

(i) each unique non-planar topographical definition of the second exposure face of the concrete blocks in the plurality being different from the second exposure face non-planar first topographical definition and the second exposure face non-planar second topographical definition and other blocks in the plurality; and (ii) each third edge of the concrete blocks in the plurality having said second irregular profile and each fourth edge having an irregular profile that is the mirror image of the second irregular profile; and (b) wherein each concrete block of the plurality of blocks is adjacent to and against another of the blocks so that respective second exposure faces are adjacent and third edges are aligned with fourth edges to create a seamless appearance.

17. The concrete block arrangement of claim 13 wherein the first concrete block and the second concrete block are dry cast concrete blocks.

18. A set of concrete blocks comprising:

(a) a first concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face having a first 3-dimensional pattern that is irregular both along the length and across the height of the first exposure face and a first generally vertical edge along the first side face and a second generally vertical edge along the second side face;

(A) the first side face at first edge having a first irregular profile;

(B) the second side face at the second edge having a profile that is the mirror image of the first side face at the first edge; and (b) a second concrete block including (i) at least 6 sides including a first generally vertical exposure face, an opposite second face, opposite planar top and bottom faces extending between the first exposure face and second face, and opposite first and second side faces extending between the first exposure face and second face and the top and bottom faces;

(ii) the first exposure face of the second concrete block having a second 3-dimensional pattern that is irregular both along the length and across the height of the first exposure face and a first generally vertical edge along the first side face and a second generally vertical edge along the second side face;

(A) the second 3-dimensional pattern being different from the first 3-dimensional pattern;

(B) the first side face at the first edge of the second concrete block having the same profile as that of the first side face at the first edge of the first concrete block; and (C) the second side face at the second edge of the second concrete block having the same profile as that of the side face at the second edge of the first concrete block;

whereby when the second edge of the second concrete block is placed adjacent the first edge of the first concrete block and the edge profiles are aligned, there is a seamless appearance along the respective first exposure faces.

19. The set of concrete blocks of claim 18 wherein:

(a) the second face of the first concrete block is a second exposure face and has a second exposure face first 3-dimensional pattern and a third generally vertical edge along the first side face and a fourth generally vertical edge along the second side face;

(i) the third edge having a second irregular profile;

(ii) the fourth edge having a profile that is the mirror image of the second irregular profile;

(b) the second face of the second concrete block is a second exposure face and has a second exposure face second 3-dimensional pattern and a third generally vertical edge along the first side face and a fourth generally vertical edge along the second side face;

(i) the second exposure face second 3-dimensional pattern being different from the second exposure face first 3-dimensional pattern;

(ii) the third edge of the second concrete block having the same irregular profile as the third edge of the first concrete block; and (iii) the fourth edge of the second concrete block having the same irregular profile as the fourth edge of the first concrete block;

whereby when the fourth edge of the second concrete block is placed adjacent the third edge of the first concrete block and the edge profiles are aligned, there is a seamless appearance along the respective second exposure faces.

20. The set of concrete blocks of claim 19 wherein the second irregular profile is generally the same shape as the first irregular profile.

21. The set of concrete blocks of claim 18 wherein the first and second blocks are one of cap blocks and retaining wall blocks.

22. The set of concrete blocks of claim 18 wherein the first and second blocks are dry cast concrete blocks.

23. A method of assembling a concrete block arrangement comprising:

(a) providing a first concrete block including at least 6 sides including a first generally vertical exposure face, an opposite second face, opposite planar top and bottom faces extending between the first exposure face and second face, and opposite first and second side faces extending between the first exposure face and second face and the top and bottom faces; the first exposure face having a non-planar first topographical definition that is irregular both along the length and across the height of the first exposure face and a first edge along the first side face and a second edge along the second side face; the first edge having a first irregular profile;

(b) providing a second concrete block including at least 6 sides including a first generally vertical exposure face, an opposite second face, opposite top and bottom faces extending between the first exposure face and second face, and opposite first and second side faces extending between the first exposure face and second face and the top and bottom faces; the first exposure face of the second concrete block having a non-planar second topographical definition that is irregular both along the length and across the height of the first exposure face and a first edge along the first side face and a second edge along the second side face; the second topographical definition being different from the first topographical definition; the second edge of the second concrete block having an irregular profile that is the mirror image of said first irregular profile; and (c) orienting the first side face of the first concrete block against the second side face of the second concrete block; and (d) aligning the first irregular profile of the first concrete block with the first irregular profile of the second concrete block to create a seamless appearance.

24. The method of claim 23 wherein:

(a) the step of providing a first concrete block includes providing the first concrete block to have the second edge to have a profile that is the mirror image of the first edge first irregular profile; and (b) the step of providing a second concrete block includes providing the second concrete block to have the first edge to have the same profile as the first edge first irregular profile.

25. The method of claim 23 further comprising:

(a) providing a plurality of concrete blocks in addition to the first and second concrete blocks; each of the concrete blocks in the plurality having (i) at least 6 sides including a first exposure face, an opposite second face, opposite top and bottom faces extending between the first exposure face and the second face, and opposite first and second side faces extending between the first exposure face and second face and the top and bottom faces;

(ii) the first exposure face of each of the concrete blocks in the plurality having a unique non-planar topographical definition, a first edge along the first side face, and a second edge along the second side face;

(A) each unique non-planar topographical definition being different from the non-planar first topographical definition and non-planar second topographical definition and other blocks in the plurality; and (B) each first edge having said first irregular profile and each second edge having an irregular profile that is the mirror image of the first irregular profile.

26. The method of claim 25 further comprising:

(a) orienting the first side face of one of the plurality of concrete blocks against the second side face of another of the plurality of concrete blocks;

(b) aligning the first irregular profile of the one concrete block with the first irregular profile of the another concrete block to create a seamless appearance; and (c) repeating the steps of orienting and aligning with the plurality of concrete blocks and forming a wall with a seamless appearance.

27. The method of claim 26 wherein:

(a) the first exposure face of each of the concrete blocks is wider than the second face of each of the concrete blocks; and (b) the step of forming a wall includes forming a curved wall with the plurality of concrete blocks.

* * * * *